US007511567B2

(12) United States Patent
Yeo et al.

(10) Patent No.: US 7,511,567 B2
(45) Date of Patent: Mar. 31, 2009

(54) BANDGAP REFERENCE VOLTAGE CIRCUIT

(75) Inventors: Kok-Soon Yeo, Singapore (SG); Wai-Keat Tai, Singapore (SG)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 295 days.

(21) Appl. No.: 11/244,840

(22) Filed: Oct. 6, 2005

(65) Prior Publication Data

US 2007/0080741 A1 Apr. 12, 2007

(51) Int. Cl.
*G05F 1/10* (2006.01)
*G05F 3/02* (2006.01)

(52) U.S. Cl. ..... 327/539

(58) Field of Classification Search ..... 327/539; 323/313

See application file for complete search history.

(56) References Cited

U.S. PATENT DOCUMENTS 4,849,684 A 7/1989 Sonntag et al.
5,614,816 A * 3/1997 Nahas ..... 323/316
5,666,046 A 9/1997 Mietus
5,900,773 A 5/1999 Susak
6,366,071 B1 * 4/2002 Yu ..... 323/316
6,563,371 B2 5/2003 Buckley, III et al.
7,199,646 B1 * 4/2007 Zupcau et al. ..... 327/539
2004/0155700 A1 * 8/2004 Gower et al. ..... 327/543
2005/0231270 A1 * 10/2005 Washburn ..... 327/539
2006/0061412 A1 * 3/2006 Molina et al. ..... 327/539

* cited by examiner

*Primary Examiner*—Quan Tra

(57) ABSTRACT

A reference voltage circuit includes first circuitry that generates a thermal voltage that is approximately proportional to absolute temperature, a first voltage multiplier, second circuitry that generates an inverse thermal voltage that is approximately inversely proportional to absolute temperature, a second voltage multiplier and a summer. The first voltage multiplier multiplies the thermal voltage to obtain a first multiplied voltage. The multiplied voltage is not equal to the thermal voltage. The second voltage multiplier multiplies the inverse thermal voltage to obtain a second multiplied voltage. The summer sums the first multiplied voltage with the second multiplied voltage to obtain a reference voltage.

12 Claims, 6 Drawing Sheets

BANDGAP REFERENCE VOLTAGE CIRCUIT

BACKGROUND

A bandgap reference voltage circuit provides an output reference that is insensitive to temperature, supply voltage and process variations. Bandgap reference voltage circuits are used in a wide variety of electronic circuits, such as wireless communication devices, memory devices, voltage regulators, filters, analog-to-digital converters, digital-to-analog converters and so on.

There are a variety of ways to generate a bandgap reference voltage that, in general, fall into two main categories. The first category is current mode generation of a bandgap reference voltage. The second category is voltage mode generation of a bandgap reference voltage.

In current mode generation of a bandgap reference voltage, current from a first current source that has a positive temperature coefficient is summed with current from a second current source that has a corresponding negative temperature coefficient to produce an output current. A bandgap reference voltage ($V_{REF}$) is achieved by passing the output current through a resistance. The use of corresponding positive and negative temperature coefficients in the first and second current sources results in the effects of temperature being canceled out, thus stabilizing the bandgap reference voltage ($V_{REF}$). For examples of bandgap reference voltage circuits that use current mode generation, see U.S. Pat. No. 5,666,046 and United States Patent Application number 2004/0155700A1.

In voltage mode generation of a bandgap reference voltage, a base-emitter voltage ($V_{BE}$) is generated from a bipolar transistor having a negative coefficient. A thermal voltage ($V_t$) is generated that is proportional-to-absolute-temperature (PTAT). The thermal voltage ($V_t$) has a positive coefficient at room temperature. The thermal voltage is equal to the expression kT/q where k is Boltzmann's constant, T is absolute temperature, and q is the elementary electron charge constant. Neither k nor q is temperature-dependent, and the result is that thermal voltage ($V_t$) is directly proportional-to-absolute-temperature (PTAT). The thermal voltage ($V_t$) is multiplied by a constant (K) and summed with the voltage ($V_{BE}$). The result is a reference voltage ($V_{REF}$) that is described by Equation 1 below:

$$V_{REF}=V_{BE}+KV_t \qquad \text{EQUATION 1}$$

For examples of voltage mode generation of a bandgap reference voltage, see for example, U.S. Pat. No. 4,849,684 and U.S. Pat. No. 5,900,773.

Current mode generation of a bandgap reference voltage has the ability to achieve a bandgap reference as low as approximately 1 volt. Additionally, current mode generation of a bandgap reference voltage can produce a programmable bandgap reference voltage as the output current has zero temperature coefficient. However, current mode generation of a bandgap reference voltage typically requires one or more relatively large resistors, which can result in a large chip size.

Voltage mode generation of a bandgap reference voltage requires smaller total resistance than current mode generation of a bandgap reference voltage, but typically cannot be used for generating a bandgap reference voltage less than about 1.2 volts. Also, using the voltage mode generation of a bandgap reference voltage, the resulting bandgap reference voltage typically is 1.2 volts or a positive integer multiple of 1.2 volts.

SUMMARY OF THE DISCLOSURE

In accordance with an embodiment of the present invention, a reference voltage circuit includes first circuitry that generates a thermal voltage that is approximately proportional to absolute temperature, a first voltage multiplier, second circuitry that generates an inverse thermal voltage that is approximately inversely proportional to absolute temperature, a second voltage multiplier and a summer. The first voltage multiplier multiplies the thermal voltage to obtain a first multiplied voltage. The multiplied voltage is not equal to the thermal voltage. The second voltage multiplier multiplies the inverse thermal voltage to obtain a second multiplied voltage. The summer sums the first multiplied voltage with the second multiplied voltage to obtain a reference voltage.

DESCRIPTION OF THE EMBODIMENTS

Figure 1:
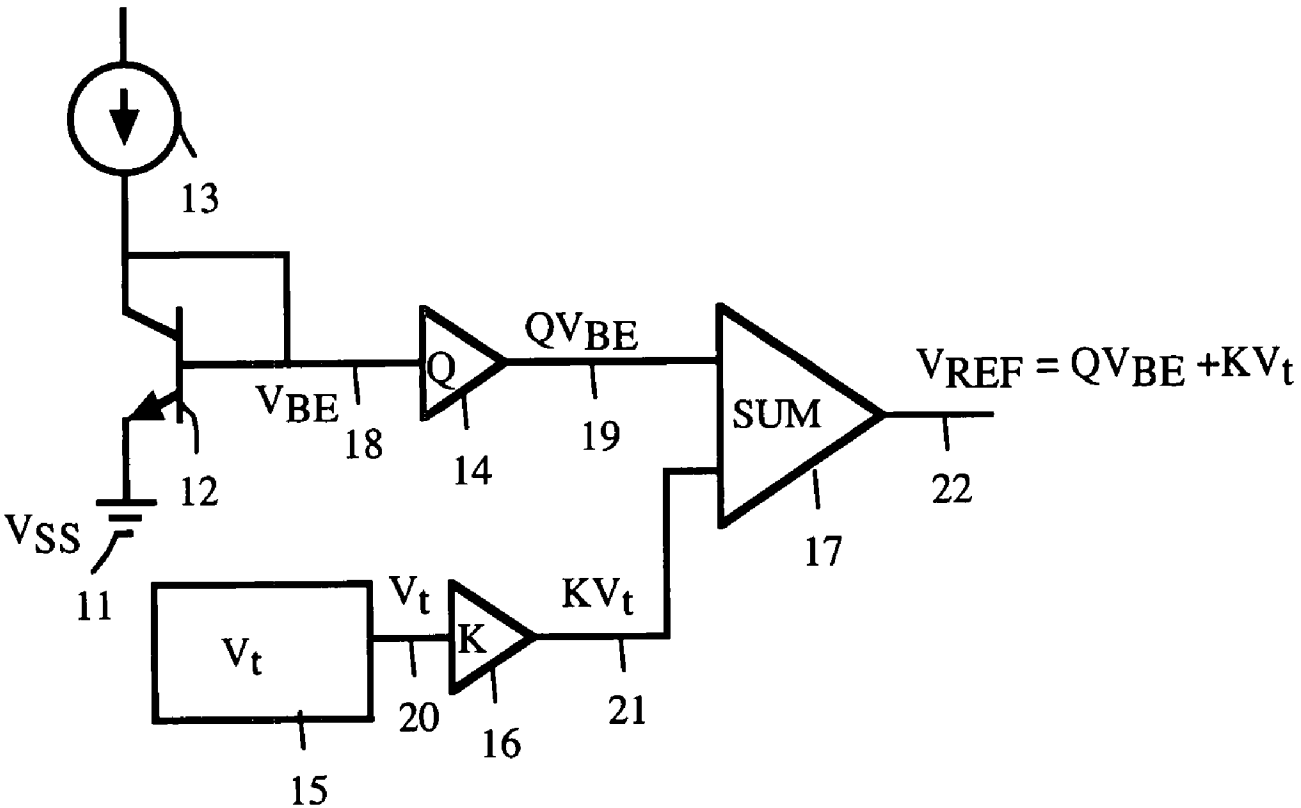
FIG. 1 shows a block diagram of a circuit that generates a bandgap reference voltage in accordance with another embodiment of the present invention.

FIG. 1 shows a block diagram of a circuit that generates a bandgap reference voltage ($V_{REF}$) on an output 22. A base-emitter voltage ($V_{BE}$) at a location 18 is generated by a diode 12. Diode 12 is connected to a current source 13 and source-to-source voltage ($V_{SS}$) 11. For example, diode 12 is implemented by a bipolar transistor having a negative temperature coefficient of approximately −2.2 millivolts per degree centigrade (mV/° C.). Base-emitter voltage ($V_{BE}$) is multiplied by a voltage multiplier 14 with multiplier having a constant value Q. Voltage multiplier 14 produces a signal with multiplied voltage ($QV_{BE}$) at a location 19.

A voltage generator 15 generates, at a location 20, a thermal voltage ($V_t$) that is proportional-to-absolute-temperature (PTAT). The thermal voltage ($V_t$) has a positive coefficient of, for example, +0.085 mV/° C. at room temperature. The thermal voltage is equal to the expression kT/q where k is Boltzmann's constant, T is absolute temperature, and q is the elementary electron charge constant. Neither k nor q is temperature-dependent, and the result is that thermal voltage ($V_t$) is directly proportional-to-absolute-temperature (PTAT). Thermal voltage ($V_t$) is multiplied by a voltage multiplier 16 that has a constant value K. Voltage multiplier 16 produces a signal with multiplied voltage ($KV_t$) at a location 21. A voltage sum 17 sums the voltages of the signals at location 19 and location 21 and produces bandgap reference voltage ($V_{REF}$) on output 22. Bandgap reference voltage ($V_{REF}$) can be described as set out by Equation 2 below:

$$V_{REF}=QV_{BE}+KV_t \qquad \text{EQUATION 2}$$

The constant value Q can be a fractional or an integer value. When Q is greater than 1, this results in bandgap reference voltage ($V_{REF}$) being higher than the typical bandgap voltage of 1.2 volts (V). When Q is lower than 1, this results in bandgap reference voltage ($V_{REF}$) being lower than the typical bandgap voltage of 1.2V. Selection of an appropriate value of Q allows any programmable reference voltage within the circuit range to be achieved. Minimum bandgap reference voltage ($V_{REF}$) is, for example, about 1 volt.

Differentiating with respect to temperature and using the temperature coefficients for $V_{BE}$ and $V_t$ leads to a set value of K and Q that should theoretically give zero temperature dependence. That is, bandgap reference voltage ($V_{REF}$) has a zero first order temperature coefficient.

While herein, a base-emitter voltage ($V_{BE}$) is used as an example of a voltage that is inverse to PTAT, the present invention works equally well when another type of voltage source that is inverse to PTAT is used instead of a base-emitter voltage ($V_{BE}$). For example, a voltage source that is inverse to PTAT can be generated by a diode or another type of circuitry.

Figure 2:
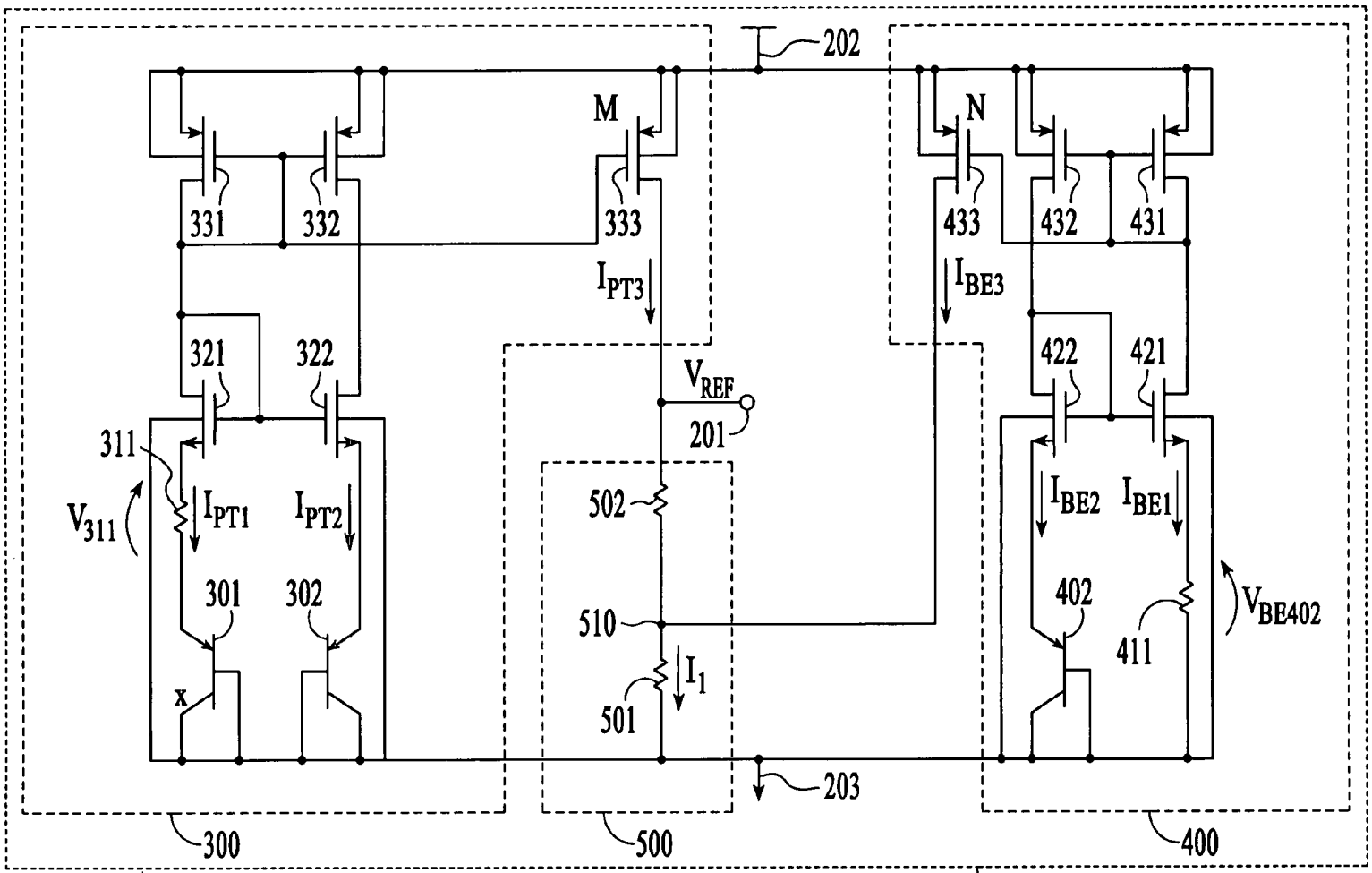
FIG. 2, FIG. 3, FIG. 4, FIG. 5 and FIG. 6 show circuit level diagrams of circuits that generate a bandgap reference voltage in accordance with embodiments of the present invention.

FIG. 2 is a circuit level diagram of a bandgap reference voltage circuit 200 that generates a bandgap reference voltage ($V_{REF}$) at a location 201, in accordance with the model shown in FIG. 1. A power supply ($V_{CC}$) voltage 202 and a ground ($V_{SS}$) voltage 203 are shown. Bandgap reference voltage circuit 200 includes a PTAT current source through circuit 300, a $V_{BE}$ current source circuit 400 and a sum circuit 500.

PTAT current source through circuit 300 includes a pnp bipolar transistor 301, a pnp bipolar transistor 302, an n-channel field effect transistor (FET) 321, an n-channel FET 322, a p-channel FET 331, a p-channel FET 332, a p-channel FET 333 and a resistor 311, connected as shown. $V_{BE}$ current source circuit 400 includes a pnp bipolar transistor 402, an n-channel FET 421, an n-channel FET 422, a p-channel FET 431, a p-channel FET 432, a p-channel FET 433 and a resistor 411, connected as shown. Sum circuit 500 includes a resistor 501, a resistor 502 and a node 510. Locations of a current $I_{PT1}$, a current $I_{PT2}$ a current $I_{PT3}$, a current $I_{BE1}$ a current $I_{BE2}$, a current $I_{BE3}$ are as shown. $V_{311}$ is the voltage that occurs across resistance 311. The thermal voltage ($V_t$) is the fractional of the voltage $V_{311}$. Base emitter voltage ($V_{BE}$) is the voltage that occurs across resistance 411.

To achieve the PTAT current ($I_{PT3}$), the thermal voltage $V_t$ is generated across the resistor 311 using FETs 331, 332, 321 and 322 together with pn transistor diodes 301 and 302. FET 331, FET 332, FET 321 and FET 322 function as current mirrors. FET 331 and FET 332 are the same size. Likewise, FET 321, and FET 322 are the same size. This insures that current $I_{PT1}$ is equal to current $I_{PT2}$. The emitter area ($A_{301}$) of PNP bipolar transistor 301 is scaled relative to the emitter area ($A_{302}$), of PNP bipolar transistor 302. The scaling factor is designated by the variable "x" shown on FIG. 2. The relationship between the emitter areas of PNP bipolar transistors 301 and 302 is given by Equation 3 below:

$$A_{301}=x*A_{302} \qquad \text{EQUATION 3}$$

For example, bipolar transistor 301 and bipolar transistor 302 are fabricated in near proximity to each other and are well-matched so that bipolar transistor 301 and bipolar transistor 302 operate at the same emitter current. The difference ($\Delta V_{BE}$) in their base-to-emitter voltage is given by Equation 4 below:

$$\Delta V_{BE}=V_{311}=(k*T/q)*In(x) \qquad \text{EQUATION 4}$$

The current $I_{PT1}$ is also dependent on absolute temperature as demonstrated by Equation 5 below:

$$I_{PT1}=I_{PT2}=\Delta V_{BE}/R_{311}=V_{311}/R_{311}=V_t*In(x)/R_{311} \qquad \text{EQUATION 5}$$

In Equation 4, $V_{311}$ is the voltage dropped across resistor 311, the thermal voltage $V_t$ is equal to (k*T/q) which is a fractional of $V_{311}$ and $R_{311}$ is the resistance of resistor 311.

Since FET 331, FET 332 and FET 333 form current mirrors, the current $I_{PT3}$ is a multiple of $I_{PT1}$. The size of FET 333 is M times the size of FET 331 (and M times the size of FET 332), which results in the current being magnified by a factor of M. Since $I_{PT3}/I_{PT1}$=M, this results in Equation 6 below:

$$I_{PT3}=M*I_{PT1} \qquad \text{EQUATION 6}$$

Within VBE current source circuit 400, FET 431 and FET 432 are the same size. Likewise, FET 421 and FET 422 are the same size. Thus, current $I_{BE1}$ and $I_{BE2}$ are the same value. The values are given by Equation 7 below:

$$I_{BE1}=I_{BE2}=V_{BE402}/R411 \qquad \text{EQUATION 7}$$

In Equation 7, $R_{411}$ represents the resistance of resistor 411 and $V_{BE402}$ represents the base-emitter voltage drop across transistor 402.

Since FET 431, FET 432 and FET 433 form current mirrors, the current $I_{BE3}$ is a multiple of $I_{BE1}$. FET 433 is N times the size of FET 431 and of FET 432, as represented by N shown on FIG. 2. This results in Equation 8 below:

$$I_{BE3}=N*I_{BE1} \qquad \text{EQUATION 8}$$

Current $I_{BE3}$ flows in to resistor 501 to generate part of the voltage drop across 501. The part of the voltage drop across 501 generated by $I_{BE3}$ is represented by $V_{BE_REF}$, as further described by Equation 9 below:

$$V_{REF_BE}=I_{BE3}*R_{501}=N*I_{BE1}*R_{501}=N*V_{BE402}*R_{501}/R_{411}=Q*V_{BE402} \qquad \text{EQUATION 9}$$

In Equation 9, $Q=N*R_{501}/R_{411}$ and $R_{501}$ represents the resistance of resistor 501. By appropriately choosing the value of N, $R_{501}$ and $R_{411}$, the value of Q can be higher than one or lower than one.

The currents $I_{PT3}$ and $I_{BE3}$ are summed at node 510. The reference voltage $V_{REF}$ at node 201 can be generated as shown by Equations 10 below:

$$\begin{aligned} V_{REF} &= I_{PT3}*R_{502}+(I_{PT3}+I_{BE3})*R_{501} \qquad \text{EQUATIONS 10} \\ &= I_{PT3}*(R_{502}+R_{501})+I_{BE3}*R_{501} \\ &= M*I_{PT1}*(R_{502}+R_{501})+N*I_{BE1}*R_{501} \\ &= M*V_t*In(x)*(R_{502}+R_{501})/R_{311}+N* \\ &\quad V_{BE402}*R_{501}/R_{411} \\ &= K*V_t+Q*V_{BE402} \end{aligned}$$

where $K=M*In(x)*(R_{502}+R_{501})/R_{311}$ $Q=N*R_{501}/R_{411}$

In Equations 10, $R_{502}$ represents the resistance of resistor 502. With proper selection of values of K and Q the reference voltage $V_{REF}$ can be of any desired voltage within the range of the circuit. Further $V_{REF}$ is a first order temperature compensated reference voltage. Depending on the Q value, the $V_{REF}$ can be higher or lower than the typical bandgap voltage, 1.2V. If the value for Q is higher than 1, then $V_{REF}$ can be higher than 1.2V. If the value for Q is lower than 1, then the reference voltage is lower than 1.2V. The selection of K, that is, the selection of M and $R_{502}$, depends on the value of Q, because K is used to compensate the negative temperature coefficient of the voltage $V_{BE402}$.

For example, for a Chartered Semiconductor Manufacturing (CSM) 0.35 micrometer (μm) process where VCC=3 volts, x=8, M=N=1, $R_{311}$=20 kilohm, $R_{411}$=90 Kilohm, $R_{501}$=36 kilohm and $R_{502}$=37 kilohm it is possible to achieve $V_{REF}$ of approximately 0.5 volts that is almost independent of temperature. Likewise, for a CSM 0.35 μm process when VCC=3 volts, x=8, M=N=1, $R_{311}$=20 kilohm, $R_{411}$=40 Kilohm, $R_{501}$=48 kilohm and $R_{502}$=161 kilohm it is possible to achieve $V_{REF}$ of approximately 1.5 volts that is almost independent of temperature.

In another embodiment of the present invention, FET pair 321 and 322, and FET pair 421 and 422 can be replaced by operational amplifiers. An advantage of using operation amplifiers is that it can improve power supply voltage rejection ratio (PSRR) performance. An example circuit is shown in FIG. 3.

Figure 3:
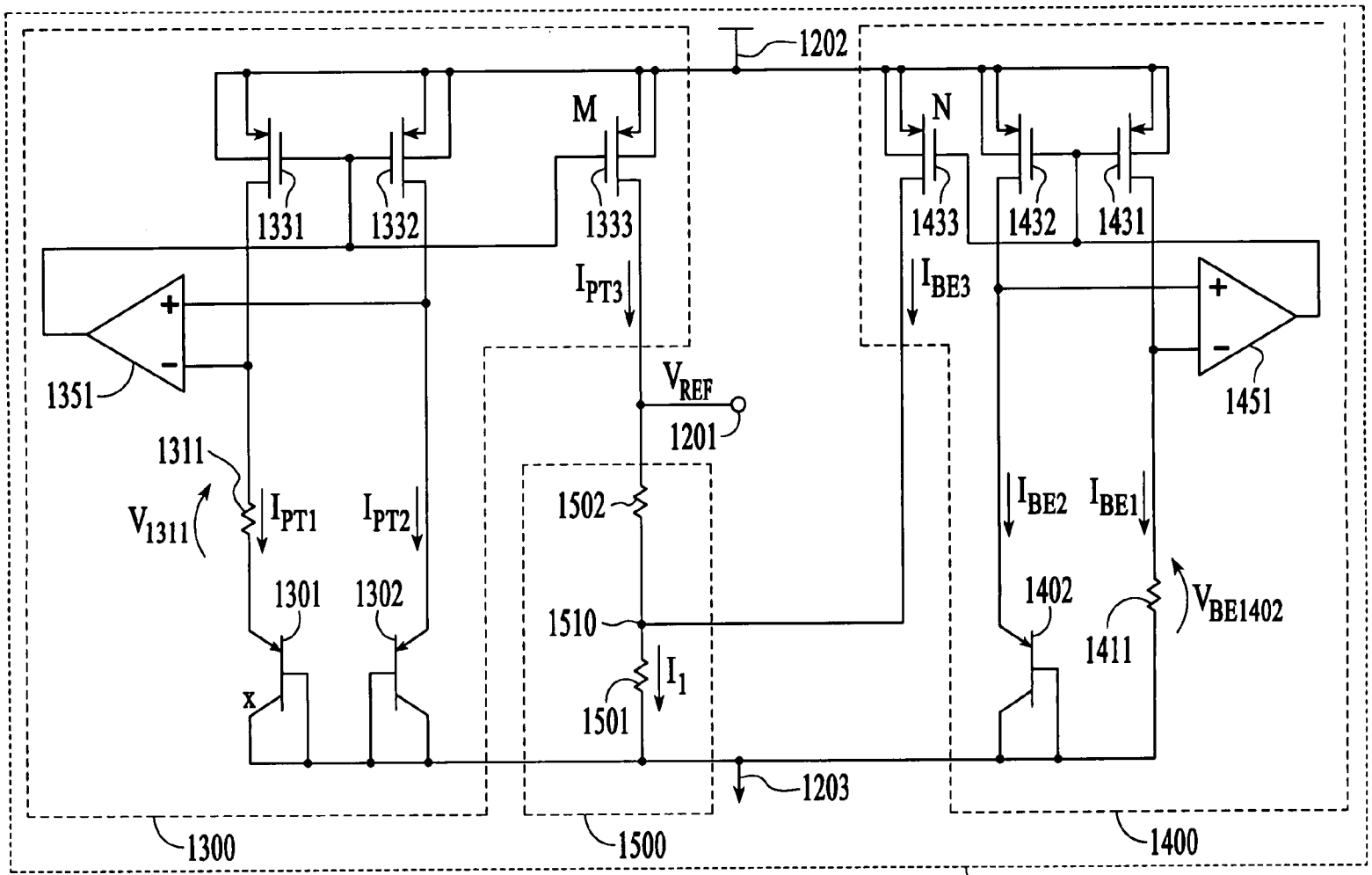

FIG. 3 is a circuit level diagram of a bandgap reference voltage circuit 1200 that generates a bandgap reference voltage ($V_{REF}$) at a location 1201, in accordance with the model shown in FIG. 1. A VCC voltage 1202 and a ground voltage 1203 are shown. Bandgap reference voltage circuit 1200 includes a PTAT current source through circuit 1300, a $V_{BE}$ current source circuit 1400 and a sum circuit 1500.

PTAT current source through circuit 1300 includes a pnp bipolar transistor 1301, a pnp bipolar transistor 1302, an operational amplifier 1351, a p-channel FET 1331, a p-channel FET 1332, a p-channel FET 1333 and a resistor 1311, connected as shown. $V_{BE}$ current source circuit 1400 includes a pnp bipolar transistor 1402, an operational amplifier 1451, a p-channel FET 1431, a p-channel FET 1432, a p-channel FET 1433 and a resistor 1411, connected as shown. Sum circuit 1500 includes a resistor 1501, a resistor 1502 and a node 1510. Locations of a current $I_{PT1}$, a current $I_{PT2}$, a current $I_{PT3}$, a current $I_{BE1}$, a current $I_{BE2}$, a current $I_{BE3}$, x, M and N are as shown. $V_{1311}$ is the voltage that occurs across resistance 1311, the thermal voltage $V_t$ is equal to (k*T/q) which is a fractional of $V_{1311}$. Base emitter voltage ($V_{BE1402}$) is the voltage that occurs across resistance 1411.

In another embodiment of the present invention, pnp bipolar transistor 1402 can be eliminated and the base emitter voltage across pnp bipolar transistor 1302 can be used in place of the base emitter voltage across pnp bipolar transistor 1302. This is illustrated by FIG. 4.

Figure 4:
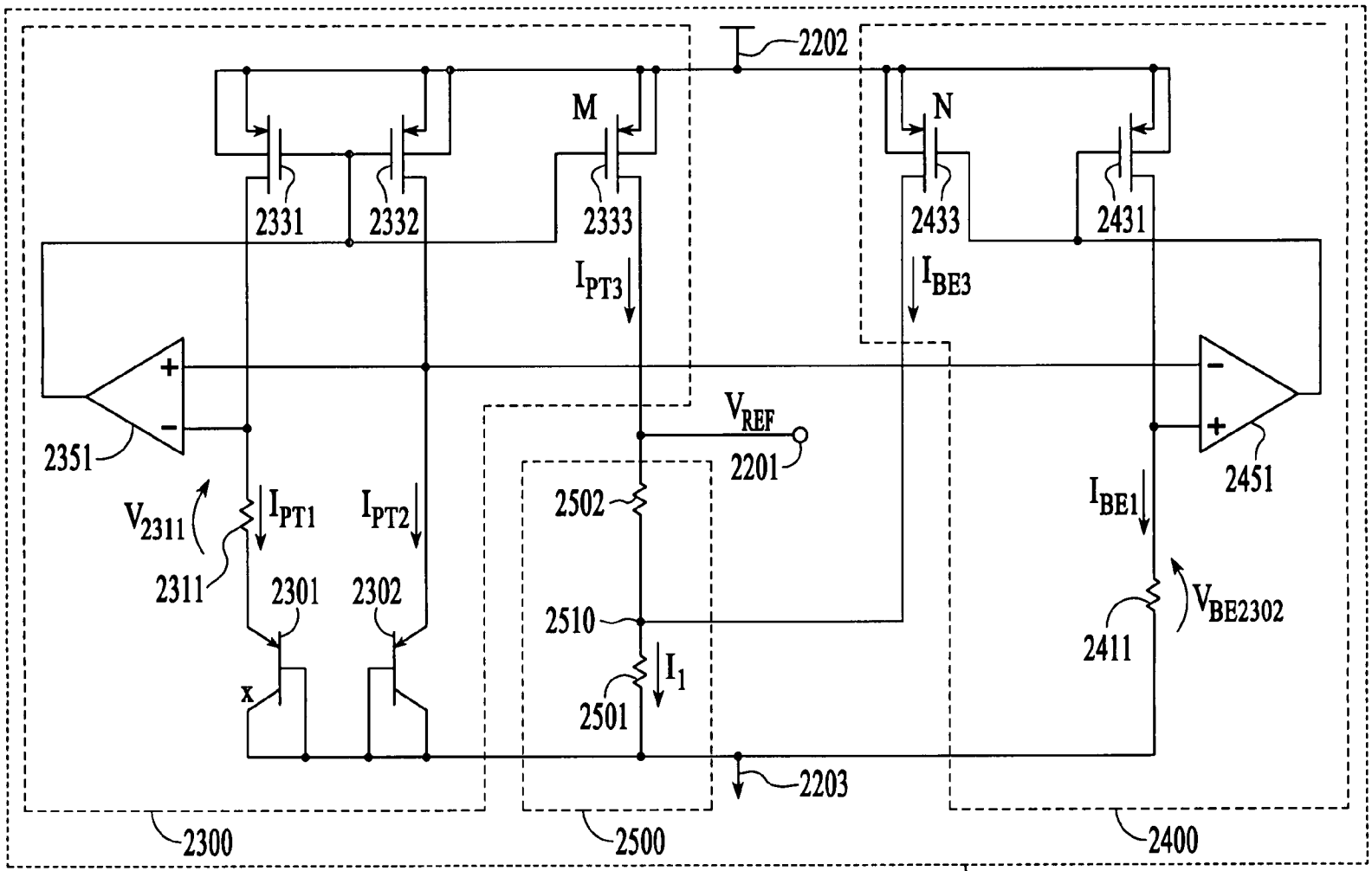

FIG. 4 is a circuit level diagram of a bandgap reference voltage circuit 2200 that generates a bandgap reference voltage ($V_{REF}$) at a location 2201, in accordance with the model shown in FIG. 1. A VCC voltage 2202 and a ground voltage 2203 are shown. Bandgap reference voltage circuit 2200 includes a PTAT current source through circuit 2300, a $V_{BE}$ current source circuit 2400 and a sum circuit 2500.

PTAT current source through circuit 2300 includes a pnp bipolar transistor 2301, a pnp bipolar transistor 2302, an operational amplifier 2351, a p-channel FET 2331, a p-channel FET 2332, a p-channel FET 2333 and a resistor 2311, connected as shown. $V_{BE}$ current source circuit 2400 includes an operational amplifier 2451, a p-channel FET 2431, a p-channel FET 2433 and a resistor 2411, connected as shown. Sum circuit 2500 includes a resistor 2501, a resistor 2502 and a node 2510. Locations of current $I_{PT1}$, a current $I_{PT2}$, a current $I_{PT3}$, a current $I_{BE1}$, a current $I_{BE3}$, x, M and N are as shown. $V_{2311}$ is the voltage that occurs across resistance 2311, the thermal voltage $V_t$ is equal to (k*T/q) which is a fractional of $V_{2311}$. Base emitter voltage ($V_{BE2302}$) is the voltage that occurs across resistance 2411.

In another embodiment of the present invention multiple reference voltages can be generated. Each reference voltage can have a different voltage level and all can be independent of temperature. This is illustrated by FIG. 5.

Figure 5:
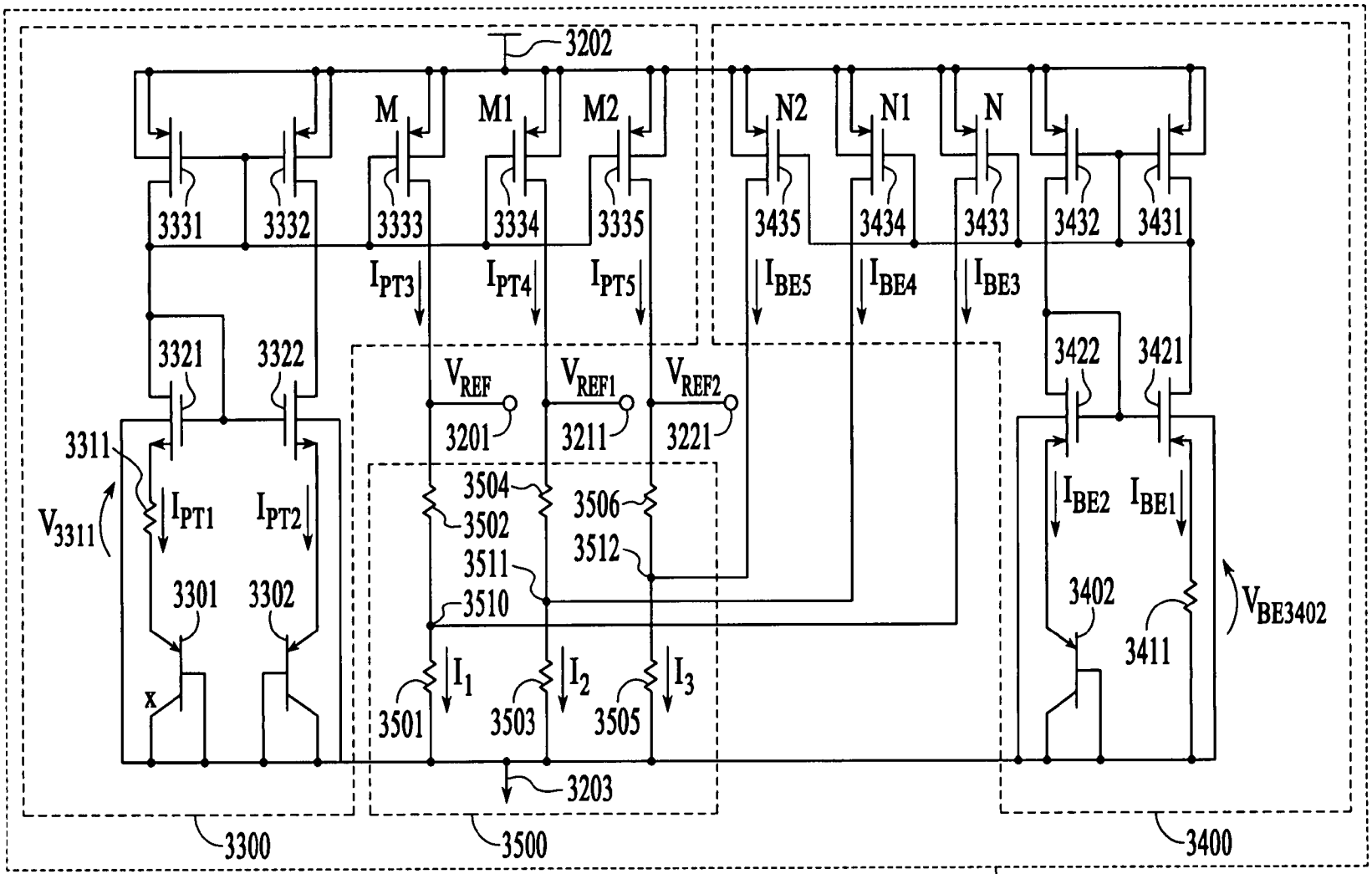

FIG. 5 is a circuit level diagram of a bandgap reference voltage circuit 3200 that generates a bandgap reference voltage ($V_{REF}$) at a location 3201, in accordance with the model shown in FIG. 1. Bandgap reference voltage circuit 3200 also generates a bandgap reference voltage (V REF) at a location 3211 and a bandgap reference voltage ($V_{REF2}$) at a location 3221. A VCC voltage 3202 and a ground voltage 3203 are shown. Bandgap reference voltage circuit 3200 includes a PTAT current source through circuit 3300, a $V_{BE}$ current source circuit 3400 and a sum circuit 3500.

PTAT current source through circuit 3300 includes a pnp bipolar transistor 3301, a pnp bipolar transistor 3302, an n-channel FET 3321, an n-channel FET 3322, a p-channel FET 3331, a p-channel FET 3332, a p-channel FET 3333, a p-channel FET 3334, a p-channel FET 3335 and a resistor 3311, connected as shown. $V_{BE}$ current source circuit 3400 includes a pnp bipolar transistor 3402, an n-channel FET 3421, an n-channel FET 3422, a p-channel FET 3431, a p-channel FET 3432, a p-channel FET 3433, a p-channel FET 3434, a p-channel FET 3435 and a resistor 3411, connected as shown. Sum circuit 3500 includes a resistor 3501, a resistor 3502, a resistor 3503, a resistor 3504, a resistor 3505, a resistor 3506, a node 3510, a node 3511 and a node 3512. Locations of a current $I_{PT1}$, a current $I_{PT2}$, a current $I_{PT3}$, a current $I_{PT4}$, a current $I_{PT5}$, a current $I_{BE1}$, a current $I_{BE2}$, a current $I_{BE3}$, a current $I_{BE4}$ a current $I_{BE5}$ x, M, M1, M2, N, N1 and N2, are as shown. $V_{3311}$ is the voltage that occurs across resistance 3311, the thermal voltage $V_t$ is equal to (k*T/q) which is a fractional of $V_{3311}$. Base emitter voltage ($V_{BE3402}$) is the voltage that occurs across resistance 3411.

By appropriately selecting values of M, M1, M2, N, N1, N2, and the values of resistors 3501, 3502, 3503, 3504, 3505 and 3506, resulting in different values for K and Q, different voltage references for $V_{REF}$, $V_{REF1}$, $V_{REF2}$ can be generated. In alternative embodiments (not shown), operational amplifiers can be used to replace the n-channel FETs shown in FIG. 5, similar to how operational amplifiers are used in FIGS. 3 and 4, to achieve good PSRR performance.

In the circuits shown in FIGS. 2 through 5, the voltage $V_{BE}$ is converted into a corresponding current before, using a resistor, it is converted back to a voltage. It is also possible to directly add part of the voltage $V_{BE}$ into the bandgap reference voltage ($V_{REF}$) through different circuit topographies. For example, FIG. 6 below shows an example of this.

Figure 6:
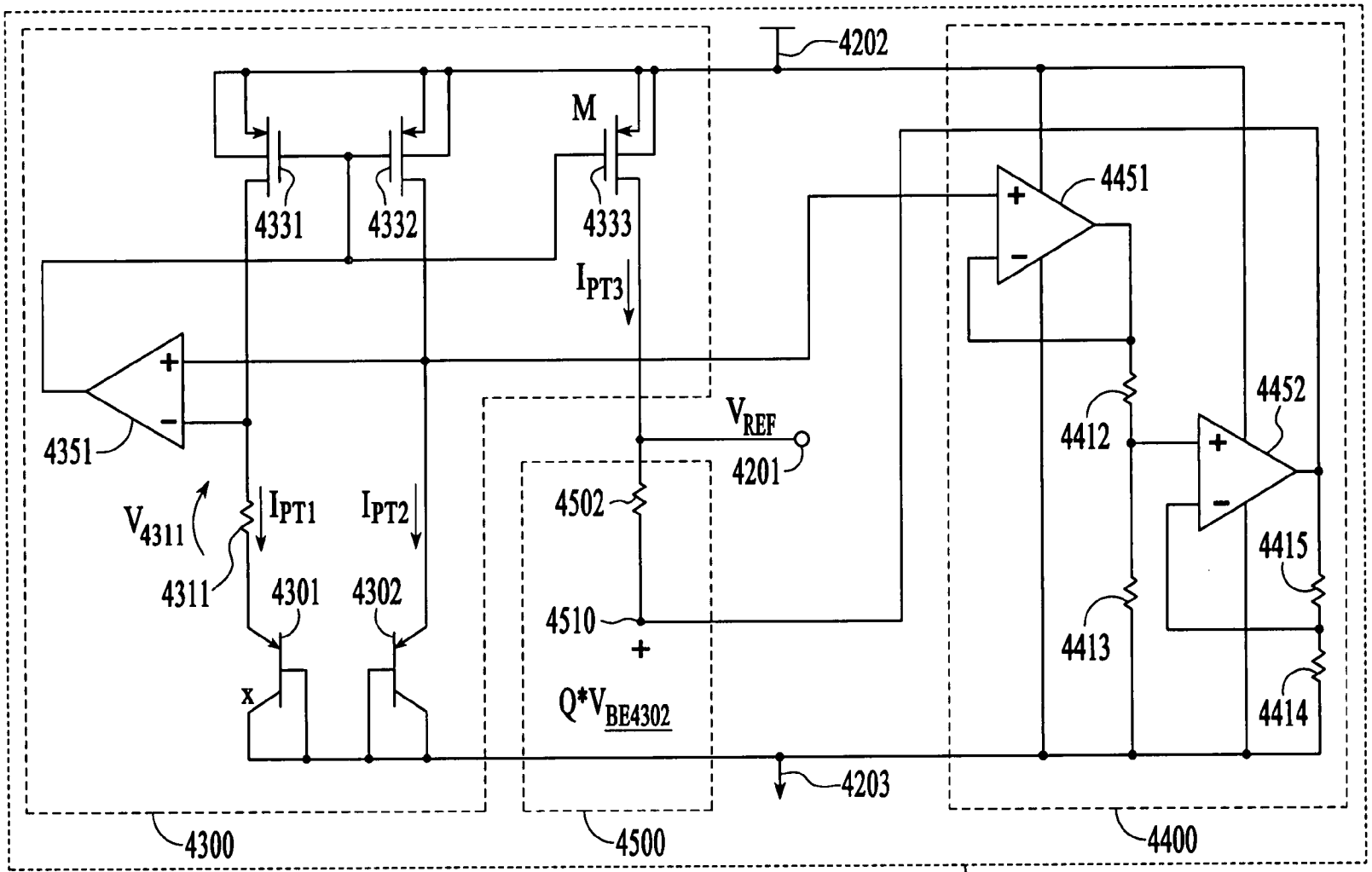

FIG. 6 is a circuit level diagram of a bandgap reference voltage circuit 4200 that generates a bandgap reference voltage ($V_{REF}$) at a location 4201, in accordance with the model shown in FIG. 1. A VCC voltage 4202 and a ground voltage 4203 are shown. Bandgap reference voltage circuit 4200 includes a PTAT current source through circuit 4300, a $V_{BE}$ current source circuit 4400 and a sum circuit 4500.

PTAT current source through circuit 4300 includes a pnp bipolar transistor 4301, a pnp bipolar transistor 4302, an operational amplifier 4351, a p-channel FET 4331, a p-channel FET 4332, a p-channel FET 4333 and a resistor 4311, connected as shown. $V_{BE}$ current source circuit 4400 includes an operational amplifier 4451, an operational amplifier 4452, a resistor 4412, a resistor 4413, a resistor 4414 and a resistor 4415, connected as shown. Sum circuit 4500 includes a resistor 4502 and a node 4510. Locations of current $I_{PT1}$, a current $I_{PT2}$ and a current $I_{PT3}$, a current $I_{BE1}$, a current $I_{BE3}$, x and M are as shown. $V_{4311}$ is the voltage that occurs across resistance 4311, the thermal voltage $V_t$ is equal to (k*T/q) which is a fractional of $V_{4311}$. Base emitter voltage ($V_{BE}$) is the voltage ($V_{BE4302}$) that occurs across pnp bipolar transistor 4302. As shown in FIG. 6, the voltage between node 4510 and ground 4203 is equal to $Q*V_{BE4302}$.

For FIG. 6, the bandgap reference voltage ($V_{REF}$) is given by Equations 11, below:

$$\begin{aligned} V_{REF} &= I_{PT3} * R_{4502} + Q * V_{BE4302} \\ &= M * V_t * R_{4502} / R_{4311} + Q * V_{BE4302} \\ &= K * V_t + Q * V_{BE4302} \end{aligned} \qquad \text{EQUATIONS 11}$$

where $Q=[R_{4413}/(R_{4412}+R_{4413})]*[1+R_{4415}/R_{4414}]$ $K=M*R_{4502}/R_{4311}$ The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A reference voltage circuit, comprising:

a first means for generating a thermal voltage and multiplying the thermal voltage to obtain a first multiplied voltage, the multiplied voltage not being equal to the thermal voltage, wherein the thermal voltage is approximately proportional to absolute temperature, wherein the first means includes:

a first field effect transistor (FET) having a source, a gate and a drain, the source of the first FET being connected to a power supply for the reference voltage circuit and the gate of the first FET being connected to the drain of the first FET, a second FET having a source, a gate and a drain, the source of the second FET being connected to the power supply, and the gate of the second FET being connected to the gate of the first FET, a third FET having a source, a gate and a drain, the source of the third FET being connected to the power supply, and the gate of the third FET being connected to the gate of the first FET, a fourth FET having a source, a gate and a drain, the drain of the fourth FET being connected to the drain of the first FET and the gate of the fourth FET being connected to the drain of the fourth FET, a fifth FET having a source, a gate and a drain, the drain of the fifth FET being connected to the drain of the second FET and the gate of the fifth FET being connected to the drain of the second FET, a first bipolar transistor having an emitter, a collector and a base, the base and the collector of the first bipolar transistor being connected to a ground for the reference voltage circuit, a second bipolar transistor having an emitter, a collector and a base, the base and the collector of the second bipolar transistor being connected to the ground, and the emitter for the second bipolar transistor being connected to the source of the fifth FET, and a first resistor connected between the source of the fourth FET and the emitter or the first bipolar transistor;

a second means for generating an inverse thermal voltage that is approximately inversely proportional to absolute temperature and multiplying the inverse thermal voltage to obtain a second multiplied voltage, wherein the second means includes:

a sixth FET having a source, a gate and a drain, the source of the sixth FET being connected to the power supply, a seventh FET having a source, a gate and a drain, the source of the seventh FET being connected to the power supply, and the gate of the seventh FET being connected to the gate of the sixth FET, an eighth FET having a source, a gate and a drain, the source of the eighth FET being connected to the power supply, and the gate of the eighth FET being connected to the gate of the sixth FET, a ninth FET having a source, a gate and a drain, the drain of the ninth FET being connected to the drain of the sixth FET, and the gate of the ninth FET being connected to the drain of the ninth FET, a tenth FET having a source, a gate and a drain, the drain of the tenth FET being connected to the drain of the seventh FET, and the gate of the tenth FET being connected to the drain of the ninth FET, a third bipolar transistor having an emitter, a collector and a base, the base and the collector of the third bipolar transistor being connected to the ground, and the emitter for the third bipolar transistor being connected to the source of the ninth FET, and a second resistor connected between the source of the tenth FET and the ground; and, a third means for summing the first multiplied voltage with the second multiplied voltage to obtain a reference voltage, wherein the third means includes:

a third resistor connected between the drain of the eighth FET and the ground, and a fourth resistor connected between the drain of the third FET and the drain of the eighth FET.

2. A reference voltage circuit as in claim 1:

wherein the first means additionally includes:

an eleventh FET having a source, a gate and a drain, the source of the eleventh FET being connected to the power supply, and the gate of the eleventh FET being connected to the gate of the first FET, and a twelfth FET having a source, a gate and a drain, the source of the twelfth FET being connected to the power supply, and the gate of the twelfth FET being connected to the gate of the first FET;

wherein the second means additionally includes:

a thirteenth FET having a source, a gate and a drain, the source of the thirteenth FET being connected to the power supply, and the gate of the thirteenth FET being connected to the gate of the sixth FET, and a fourteenth FET having a source, a gate and a drain, the source of the fourteenth FET being connected to the power supply, and the gate of the fourteenth FET being connected to the gate of the sixth FET; and, wherein the third means additionally includes:

a fifth resistor connected between the drain of the thirteenth FET and the ground, a sixth resistor connected between the drain of the eleventh FET and the drain of the thirteenth FET, a seventh resistor connected between the drain of the fourteenth FET and the ground, and a eighth resistor connected between the drain of the twelfth FET and the drain of the fourteenth FET.

3. A reference voltage circuit, comprising:

a first means for generating a thermal voltage and multiplying the thermal voltage to obtain a first multiplied voltage, the multiplied voltage not being equal to the thermal voltage, wherein the thermal voltage is approximately proportional to absolute temperature, wherein the first means includes:

a first field effect transistor (FET) having a source, a gate and a drain, the source of the first FET being connected to a power supply for the reference voltage circuit, a second FET having a source, a gate and a drain, the source of the second FET being connected to the power supply, and the gate of the second FET being connected to the gate of the first FET, a third FET having a source, a gate and a drain, the source of the third FET being connected to the power supply, and the gate of the third FET being connected to the gate of the first FET, a first bipolar transistor having an emitter, a collector and a base, the base and the collector of the first bipolar transistor being connected to a ground for the reference voltage circuit, a second bipolar transistor having an emitter, a collector and a base, the base and the collector of the second bipolar transistor being connected to the ground, and the emitter for the second bipolar transistor being connected to the drain of the second FET, a first resistor connected between the drain of the first FET and the emitter or the first bipolar transistor, and a first operational amplifier (OP AMP) having a negative input, a positive input and an output, the negative input of the first OP AMP being connected to the drain of the first FET, the positive input of the first OP AMP being connected to the drain of the second FET and the output of the first OP AMP being connected to the gate of the first FET;

a second means for generating an inverse thermal voltage that is approximately inversely proportional to absolute temperature and multiplying the inverse thermal voltage to obtain a second multiplied voltage, wherein the second means includes:

a fourth FET having a source, a gate and a drain, the source of the fourth FET being connected to the power supply, a fifth FET having a source, a gate and a drain, the source of the fifth FET being connected to the power supply, and the gate of the fifth FET being connected to the gate of the fourth FET, a sixth FET having a source, a gate and a drain, the source of the sixth FET being connected to the power supply, and the gate of the sixth FET being connected to the gate of the fourth FET, a third bipolar transistor having an emitter, a collector and a base, the base and the collector of the third bipolar transistor being connected to the ground, and the emitter for the third bipolar transistor being connected to the drain of the fifth FET, a second resistor connected between the drain of the sixth FET and the ground, and a second OP AMP having a negative input, a positive input and an output, the negative input of the second OP AMP being connected to the drain of the sixth FET, the positive input of the second OP AMP being connected to the drain of the fifth FET and the output of the second OP AMP being connected to the gate of the sixth FET; and, a third means for summing the first multiplied voltage with the second multiplied voltage to obtain a reference voltage, wherein the third means includes:

a third resistor connected between the drain of the fourth FET and the ground, and a fourth resistor connected between the drain of the third FET and the drain of the fourth FET.

4. A reference voltage circuit, comprising:

a first means for generating a thermal voltage and multiplying the thermal voltage to obtain a first multiplied voltage, the multiplied voltage not being equal to the thermal voltage, wherein the thermal voltage is approximately proportional to absolute temperature, wherein the first means includes:

a first field effect transistor (FET) having a source, a gate and a drain, the source of the first FET being connected to a power supply for the reference voltage circuit, a second FET having a source, a gate and a drain, the source of the second FET being connected to the power supply, and the gate of the second FET being connected to the gate of the first FET, a third FET having a source, a gate and a drain, the source of the third FET being connected to the power supply, and the gate of the third FET being connected to the gate of the first FET, a first bipolar transistor having an emitter, a collector and a base, the base and the collector of the first bipolar transistor being connected to a ground for the reference voltage circuit, a second bipolar transistor having an emitter, a collector and a base, the base and the collector of the second bipolar transistor being connected to the ground, and the emitter for the second bipolar transistor being connected to the drain of the second FET, a first resistor connected between the drain of the first FET and the emitter of the first bipolar transistor, and a first operational amplifier (OP AMP) having a negative input, a positive input and an output, the negative input of the first OP AMP being connected to the drain of the first FET, the positive input of the first OP AMP being connected to the drain of the second FET and the output of the first OP AMP being connected to the gate of the first FET;

a second means for generating an inverse thermal voltage that is approximately inversely proportional to absolute temperature and multiplying the inverse thermal voltage to obtain a second multiplied voltage, wherein the second means includes:

a fourth FET having a source, a gate and a drain, the source of the fourth FET being connected to the power supply, a fifth FET having a source, a gate and a drain, the source of the fifth FET being connected to the power supply, and the gate of the fifth FET being connected to the gate of the fourth FET, a second resistor connected between the drain of the fourth FET and the ground, and a second OP AMP having a negative input, a positive input and an output, the negative input of the second OP AMP being connected to the drain of the second FET, the positive input of the second OP AMP being connected to the drain of the fourth FET and the output of the second OP AMP being connected to the gate of the fourth FET; and, a third means for summing the first multiplied voltage with the second multiplied voltage to obtain a reference voltage, wherein the third means includes:

a third resistor connected between the drain of the fifth FET and the ground, and a fourth resistor connected between the drain of the third FET and the drain of the fifth FET.

5. A reference voltage circuit, comprising:

a first means for generating a thermal voltage and multiplying the thermal voltage to obtain a first multiplied voltage, the multiplied voltage not being equal to the thermal voltage, wherein the thermal voltage is approximately proportional to absolute temperature, wherein the first means includes:

a first field effect transistor (FET) having a source, a gate and a drain, the source of the first FET being connected to a power supply for the reference voltage circuit, a second FET having a source, a gate and a drain, the source of the second FET being connected to the power supply, and the gate of the second FET being connected to the gate of the first FET, a third FET having a source, a gate and a drain, the source of the third FET being connected to the power supply, and the gate of the third FET being connected to the gate of the first FET, a first bipolar transistor having an emitter, a collector and a base, the base and the collector of the first bipolar transistor being connected to a ground for the reference voltage circuit, a second bipolar transistor having an emitter, a collector and a base, the base and the collector of the second bipolar transistor being connected to the ground, and the emitter for the second bipolar transistor being connected to the drain of the second FET, a first resistor connected between the drain of the first FET and the emitter or the first bipolar transistor, and a first operational amplifier (OP AMP) having a negative input, a positive input and an output, the negative input of the first OP AMP being connected to the drain of the first FET, the positive input of the first OP AMP being connected to the drain of the second FET and the output of the first OP AMP being connected to the gate of the first FET;

a second means for generating an inverse thermal voltage that is approximately inversely proportional to absolute temperature and multiplying the inverse thermal voltage to obtain a second multiplied voltage, wherein the second means includes:

a second OP AMP having a negative input, a positive input and an output, the positive input of the second OP AMP being connected to the drain of the second FET and the negative input of the second OP AMP being connected to the output of the second OP AMP, a third OP AMP having a negative input, a positive input and an output, a second resistor connected between the output of the second OP AMP and the positive input of the third OP AMP, a third resistor connected between the positive input of the third OP AMP and the ground, a fourth resistor connected between the output of the third OP AMP and the negative input of the third OP AMP, and a fifth resistor connected between the negative input of the third OP AMP and the ground; and, a third means for summing the first multiplied voltage with the second multiplied voltage to obtain a reference voltage, wherein the third means includes:

a sixth resistor connected between the drain of the third FET and the output of the third OP AMP.

6. A reference voltage circuit, comprising:

a proportional-to-absolute-temperature (PTAT) current source circuit configured to output a PTAT current ($I_{PAT}$);

a base-emitter current source circuit configured to output an $I_{BE}$ current, the base-emitter current source circuit having a current mirror configuration comprising a pair of transistors operable to propagate an $I_{BE1}$ current through a $V_{BE}$ resistor coupled to one of a source or a drain of one of the pair of transistors; and a sum circuit comprising a first resistor ($R_1$)coupled to a second resistor ($R_2$) with a summing node N located at the junction of the first and the second resistors, wherein a distal end of the first resistor ($R_1$)is coupled to the PTAT current source circuit for propagating the PTAT current through the first and the second resistors, and wherein the summing node N is coupled to the base-emitter current source circuit for propagating the $I_{BE}$ current through the second resistor ($R_2$), thereby providing for a summing of the $I_{BE}$ current and the PTAT current through the second resistor ($R_2$) and generation of a reference voltage ($V_{REF}$) at the summing node N, the reference voltage ($V_{REF}$) defined by a first equation $V_{REF}=I_{PAT}*R_1+(I_{PAT}+I_{BE})*R_2$ and further defined by a constant (Q) that is directly proportional to a ratio of the second resistor ($R_2$) to the $V_{BE}$ resistor.

7. The reference voltage circuit as in claim 6 wherein the resistance values of the $V_{BE}$ resistor and the second resistor ($R_2$) are selected to generate a desired reference voltage ($V_{REF}$).

8. The reference voltage circuit as in claim 6, wherein the base-emitter current source circuit further comprises an output transistor having a size parameter N that is selected for generating the $I_{BE}$ current as a multiple of the $I_{BE1}$ current and defined by a second equation $I_{BE}=N*I_{BE1}$.

9. The reference voltage circuit as in claim 6, wherein the ratio of the second resistor ($R_2$) to the $V_{BE}$ resistor is selected for setting Q to a value less than one.

10. The reference voltage circuit as in claim 6, wherein the ratio of the second resistor ($R_2$) to the $V_{BE}$ resistor is selected for setting Q to a value greater than one.

11. The reference voltage circuit as in claim 6, wherein the pair of transistors is a pair of N-channel FETs.

12. The reference voltage circuit as in claim 6, wherein the pair of transistors is a pair of P-channel FETs.

* * * * *

UNITED STATES PATENT AND TRADEMARK OFFICE

CERTIFICATE OF CORRECTION

PATENT NO. : 7,511,567 B2
APPLICATION NO. : 11/244840
DATED : March 31, 2009
INVENTOR(S) : Wai Keat Tai and Kok-Soon Yeo It is certified that error appears in the above-identified patent and that said Letters Patent is hereby corrected as shown below:

Column 12, Line 13, Claim 6, delete "($R_1$)is" and insert --($R_1$) is--.

Column 12, Line 16, Claim 6, delete "($R_1$)is:" and insert --($R_1$) is--.

Column 12, Line 29, Claim 7, delete "claim 6" and insert --claim 6,--.

Signed and Sealed this
Twenty-sixth Day of February, 2013

Teresa Stanek Rea
*Acting Director of the United States Patent and Trademark Office*